US005415207A

United States Patent [19]

Burgess

[11] Patent Number: 5,415,207

[45] Date of Patent: May 16, 1995

[54] APPARATUS AND METHOD FOR CONTROLLING AN OFF LOOM TAKE-UP

[75] Inventor: F. Eddie Burgess, Easley, S.C.

[73] Assignee: Diversified Systems, Inc., Greenville, S.C.

[21] Appl. No.: 173,361

[22] Filed: Dec. 22, 1993

[51] Int. Cl.[6] ..... D03D 49/20

[52] U.S. Cl. ..... 139/304

[58] Field of Search ..... 139/291 R, 304; 242/75.51, 75.5, 66, 542, 413

[56] References Cited

U.S. PATENT DOCUMENTS

| | | | |
|---|---|---|---|
| 2,104,565 | 1/1938 | Krejci . | |
| 2,509,250 | 5/1950 | Roberts . | |
| 3,525,367 | 8/1970 | Sprague . | |
| 4,146,190 | 3/1979 | Bond et al. . | |
| 4,216,804 | 8/1980 | Alexander, III et al. . | |
| 4,422,223 | 12/1983 | Haines | 242/75.51 X |
| 4,633,914 | 1/1987 | Carry . | |
| 4,727,911 | 3/1988 | Crawford et al. | 139/304 |
| 4,889,293 | 12/1989 | Duke et al. | 242/74.51 |
| 4,899,945 | 2/1990 | Jones | 242/75.51 X |

*Primary Examiner*—Andrew M. Falik
*Attorney, Agent, or Firm*—Cort Flint

[57] ABSTRACT

An apparatus and method for controlling the drive of an off loom take-up which winds cloth upon a cloth roll is disclosed. The off loom take up comprises a pair of spaced, driven take-up rollers upon which the cloth roll is supported and rotated. As cloth coming from the loom is directed to the cloth roll being wound, it passes underneath a pivotal directional roll which is supported on spaced pivotal arms. A motor controller controls an electric motor which drives the driven take-up rollers at a preset speed which allows the cloth to travel at the directional roll at a slightly slower speed than the speed at which the cloth travels leaving the take-off rolls of the loom. This establishes a predetermined downward "creep" in the movement of the pivotal directional roll. The downward movement of the directional roll is sensed by a detector. When the directional roll descends a prescribed distance, the detector momentarily sends a high speed signal to the drive motor which momentarily steps up the speed of the drive motor and the cloth roll being to take out the slack of the cloth. The preset speed is resumed and the high speed signal is discontinued. Conveniently, the tension of the cloth created by the directional roll can be adjusted to a desired tension by placing the detector object on a movable bracket so that the position at which the detector switch is activated may be varied in accordance with different descending horizontal positions of the directional roll.

25 Claims, 4 Drawing Sheets

APPARATUS AND METHOD FOR CONTROLLING AN OFF LOOM TAKE-UP

BACKGROUND OF THE INVENTION

The invention relates to a off-loom cloth take-up and more particularly to an apparatus and method for controlling the drive of the take-up in a simple and reliable manner to produce a uniformly wound cloth roll.

In the textile process of weaving cloth on a loom, the finished cloth is typically wound into a cloth roll upon leaving the loom. The cloth roll may be wound by a "take-up" device either on the loom or off the loom. The present invention has particular advantages with an off-loom take-up. The off-loom take-up typically includes a pair of spaced take-up rollers which are driven by an electric motor through a speed reducer and a suitable drive such as a chain and sprocket drive. The cloth roll is supported on the take-up rollers which rotate the cloth roll to take-up and form the cloth roll. It is important that the layers of the cloth roll are wound at a generally uniformed tension so that skewing and other undesirable characteristics of the cloth on the cloth roll are avoided.

Previously, various controls for the drive motor of the take-up rollers have been provided to impart desirable characteristics to the final cloth roll package. For example, U.S. Pat. No. 3,525,367, discloses an off-loom take-up having a tension control apparatus which selectively controls the linear rate of the warp yarn fed to the loom to automatically maintain a predetermined amount of tension on the warp yarns, and also maintain a uniform tension on the woven cloth coming from the loom as it is wound on the cloth take-up device. The cloth roll is supported on a cradle provided by spaced take-up rollers upon which the cloth roll is rotated and wound. For this purpose, the drive motor for the take-up rollers is provided so that the torque output of the motor is controlled. As the windings of the cloth roll accumulate, the increased loading on a driven take-up roller and drive motor is continuously sensed, and the torque output of the drive motor is continuously adjusted to maintain a preset fabric tension level.

U.S. Pat. No. 4,146,190, also discloses a control system for an off-loom take-up wherein an additional improvement is sought by using a spring biased dancer roll about which the cloth passes prior to reaching the cloth take-up roll. Tension variations in the cloth are secured at a point between the loom and the cloth roll, rather that at the driven take-up rollers. The tension variations cause the dancer roll to move up and down. The dancer roll is supported by spaced arms affixed to a control shaft which pivots in oscillations. A mechanical chain and sprocket drive transmits oscillations of the control shaft to a variable transformer which varies the voltage signal to the drive motor. The motor control varies the output torque of a variable torque drive motor for maintaining tension in the cloth within a desired range. U.S. Pat. No. 4,216,804, discloses a similar arrangement except that the sensing device, which is also in the form of a dancer roll carried on pivotal arms, eliminates the spring-biasing of the dancer roll, and utilizes gravity instead. In this case, the dancer roll rests on the cloth and is operated by gravity only to vary the torque output of the drive motor in response to tension variations. In this manner, a very light sensitivity is said to be provided which is advantageous in maintaining a preset fabric tension level for very lightweight fabrics. The gravity-type dancer roll continuously varies the motor control to vary the torque output of the drive motor much like Pat. No. 4,146,190. In these later two patents, variations in cloth tension are continuously sensed by the pivoting dancer roll. In turn, the pivotal movement of the dancer roll continuously varies a variable transformer which continuously varies a voltage signal to the drive motor. For example, in Pat. No. 4,216,804, a control shaft connected to the spaced pivotal arms which support the dancer roll includes a drive sprocket affixed to one end. A mechanical chain and sprocket drive includes a chain connected to a drive sprocket on an oscillating control shaft of the dancer roll and, to a drive sprocket of a variable transformer. Thus the movements of the dancer roll is mechanically transmitted by the chain and sprocket drive to the motor control to continuously vary the voltage signal and the output torque of the drive motor. While some advantages are afforded by the continuous and variable torque control, other problems are encountered by the need to have continuously moving mechanical and electrical parts. For example, the variable transformer (or rheostat) often forms a weak link in the control system because the small variations in movement of the dancer roll causes the wiper arm of the variable transformer to more or less continuously wipe over the same portion of the transformer windings. Eventually, this may cause the windings to short and the drive to fail. In this case, not only is down time required to replace the transformer device, and repair the control system, but cloth irregularities occur. Moreover, it has been thought that by continuously varying the control signal, possible over control of the system occurs resulting in a telescoping effect in the cloth roll taken up. Certain windings of the cloth roll project relative to other windings in the cloth roll causing undesirable characteristics.

Other controls have also been employed in off-loom take-ups. For example, U.S. Pat. No. 4,633,914, discloses a motor control for a off-loom take-up which detects an unusually high tension in a cloth web being taken up to terminate the take-up drive to prevent stretching and necking of the fabric being handled. The sensing device provides a time delay between sensing of the high tension and termination of the take-up drive. While intermittent controls such as high and low speed controls, have rather than continuously varying speed controls, been used for winding strand material such as wire and the like is shown in U.S. Pat. No. 2,104,656 and 2,509,250, these types of controls have not been typically incorporated in loom take-ups for cloth.

Accordingly, an object of the invention is to provide an apparatus and method for controlling the drive of an off-loom take-up in a simple and reliable manner to produce a uniform cloth roll.

Another object of the invention is to eliminate the need for continuous adjustment of a torque or speed output of a drive motor on an off-loom take-up, yet still provide a wound cloth roll of desired characteristics.

Another object of the invention is to provide a control system and method for an off-loom take-up which eliminates the need for a direct or mechanical drive connected between a motor control, such as a variable transformer, and an oscillating control shaft of a pivotal dancer roll and the resulting wear and unreliability of such moving parts.

Another object of the invention is to provide a control system and method for an off-loom take-up wherein the tension which the cloth is wound may be easily preset before or during operation.

Another object of the present invention is to provide a control system and method for an off-loom take-up wherein a preset tension applied by dancer roll to the cloth being wound may be set at a desired value and thereafter maintained uniform during the wind-up process.

SUMMARY OF THE INVENTION

The above objectives are accomplished according to the present invention by providing an off-loom take-up for winding a cloth roll from woven cloth coming from a loom wherein the take-up comprises a frame and a pair of spaced, driven take-up rollers carried by the frame. A drive motor having an output shaft rotates the driven take-up roller. A motor controller controls the speed of the drive motor. A pivotal directional roll assembly is carried by the frame and includes a directional roll about which the cloth travels from the loom to the cloth take-up roll. The directional roll has a preset vertical position. A motor controller is provided which has a preset speed signal and a high speed signal. The motor controller operates the drive motor at a generally constant speed in response to the present speed signal which corresponds to the preset position of the directional roll. The preset speed winds up the cloth at a slightly slower linear speed than the linear speed at which the cloth leaves the loom. Hence, a predetermined downward "creep" is established into the cloth which allows the directional rolls to slowly descend. The motor controller operates the drive motor momentarily at a speed which is higher than the preset speed in response to a high speed signal produced by a detector. The detector senses the movement of the pivotal directional roller to a second position vertically below the first position of the directional roll and produces the electrical signal. The motor controller momentarily operates at the drive motor at a high speed until the directional roll moves upwardly a prescribed distance away from the second position. The directional roll assembly includes first and second spaced pivotal arms carried by the frame, and the directional roll is carried by the pivotal arms.

In the preferred embodiment, the detector includes a detector switch carried either by the frame or the first pivotal arm. The detector includes a detector object carried by the other of the frame or the first pivotal arm. An adjustable attachment is provided for affixing the relative positions of the detector switch and the detector object to vary the location of the second position of the directional roll. Preferably, the detector switch comprises a magnetic proximity switch, and the detector object comprises a magnet. By affixing the detector switch or magnet at different vertical positions the second position and the point at which the drive motor is placed in high speed operation may be varied. The adjustable attachment comprises a bracket to which the detector magnet is preferably affixed; and an attachment for affixing the bracket to the first pivotal arm at a plurality of different vertical positions to vary the vertical position of the detector magnet relative to the detector switch.

A method for controlling the tension in cloth being wound into a cloth roll on an off-loom take-up can thus be had according to the invention which includes manually adjusting the motor controller to establish a preset speed differential between the take-up and this loom. The driven take-up rollers wind the cloth at a linear rate slightly slower than the linear rate at which the cloth is coming from the take-off rolls of the loom. The pivotal directional roll has a first position and a second position with a small range of each other. The detector detects movement of the directional roll to the second position below the first position of the directional roll due to the preset speed differential in cloth rate. The motor controller places the drive motor in a high speed mode of operation momentarily to raise the directional roll, and move the directional roll away from the second position. The first position of the direction roll supplies a desired tension on the cloth coming from the loom. In the method, the position of the directional roll may be adjusted to adjust the preset tension. Raising or lowering the detector object (or switch), raises or lowers the operational position of the directional roll to increase or decrease the tension, depending on the position of the biasing spring. The detector maintains the directional roll within a prescribed range of the operational position, e.g. $\frac{3}{8}$ of an inch.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
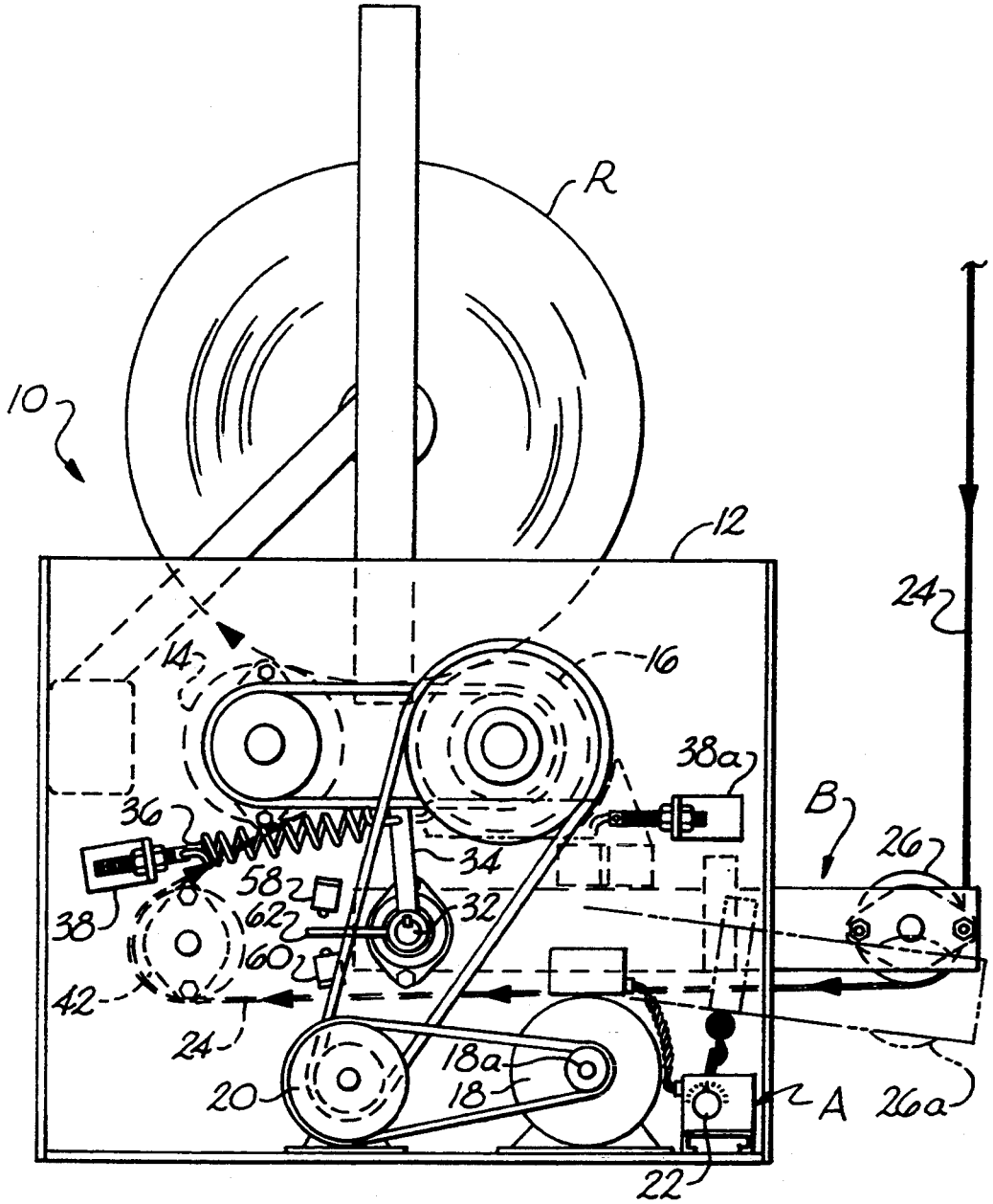
FIG. 1 is a side elevation with parts of the framed housing removed illustrating a drive and control system for an off-loom take-up constructed according to the invention.
Figure 2:
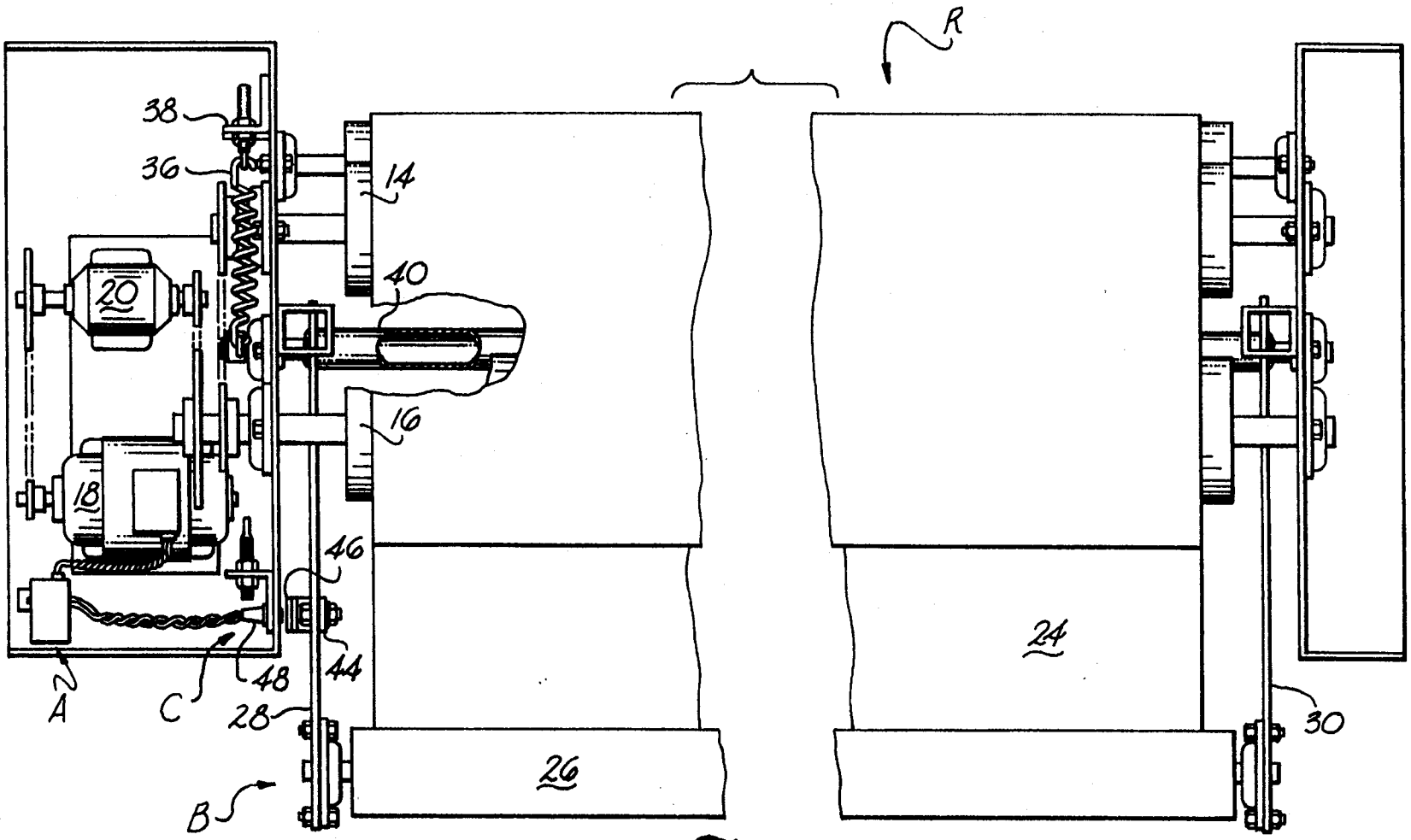
FIG. 2 is a top plan view illustrating a drive and control system for an off-loom take-up according to the invention.

Referring now in more detail to the drawings, the invention will be described. As can best be seen in FIG. 1, an off-loom take-up, designated generally as 10, is illustrated which includes a frame 12 and a pair of spaced take-up rolls 14, 16. A cloth roll, designated generally as R, which is being wound, is supported in a cradle created between the spaced take-up rolls. As illustrated, take-up rolls 14, 16 are driven by a variable speed DC motor 18 by way of a speed reducer 20. Either a belt/pulley drive, or a chain/sprocket drive connects an output shaft 18a of motor 18, the speed reducer, and driven take-up roller 16. Take-up roller 14 is interconnected by a drive belt arrangement and is driven off of take-up roller 16. This is standard to achieve a desired packing ratio. A motor controller, designated generally as A, is provided for controlling the output speed of motor 18. The controller may be any suitable programmed controller and includes a manual control knob 22 for setting the output speed of motor 18 and hence the drive speed of take-up rollers 14, 16.

A spring- biased directional roll assembly, designated generally as B, is provided which directs cloth 24 coming from the take off rolls of a loom (not shown) to cloth roll R which is being wound. Directional roll assembly B includes a directional roll 26 and a pair of spaced, pivotal arms which include a first pivotal arm 28 and a second pivotal arm 30. Arms 28, 30 pivot about a shaft 32 (FIG. 1) having an arm 34 affixed thereto. A biasing spring 36 is attached to the arm at one end and to an adjustable bracket 38 at its opposite end. Adjustable bracket 38 comprises an adjustable threaded bolt and nut which adjusts the spring tension applied by spring 36. A similar adjustable bracket 38a is disposed on an opposite side of frame 12 for applying a spring biasing force in an opposite direction. Thus, an interchangeable mount is provided for spring 36 so that the biasing force of the spring may be applied in one of two opposing directions. For example, spring 36 may be mounted on the left, as shown in full lines in FIG. 1, to exert an upward force for lighter weight fabrics, or maybe mounted to bracket **38*a* for applying a downward force on arm 28 and roll 26 for heavier fabrics. While a spring may be provided on each end of shaft 32, preferably, a hollow torsion tube 40 is welded to stub shafts 32 between the arms 28, 30. The torsion tube has a diameter of about 2 inches and effectively resists relative twisting of said first and second pivot arms, and eliminates the need for a spring on each arm. In the prior art, the necessity of a spring at each end, and adjustments to make their force equal, has been a significant problem. An idler roll 42** is provided about which the cloth travels on its path to cloth roll R.

Figure 3:
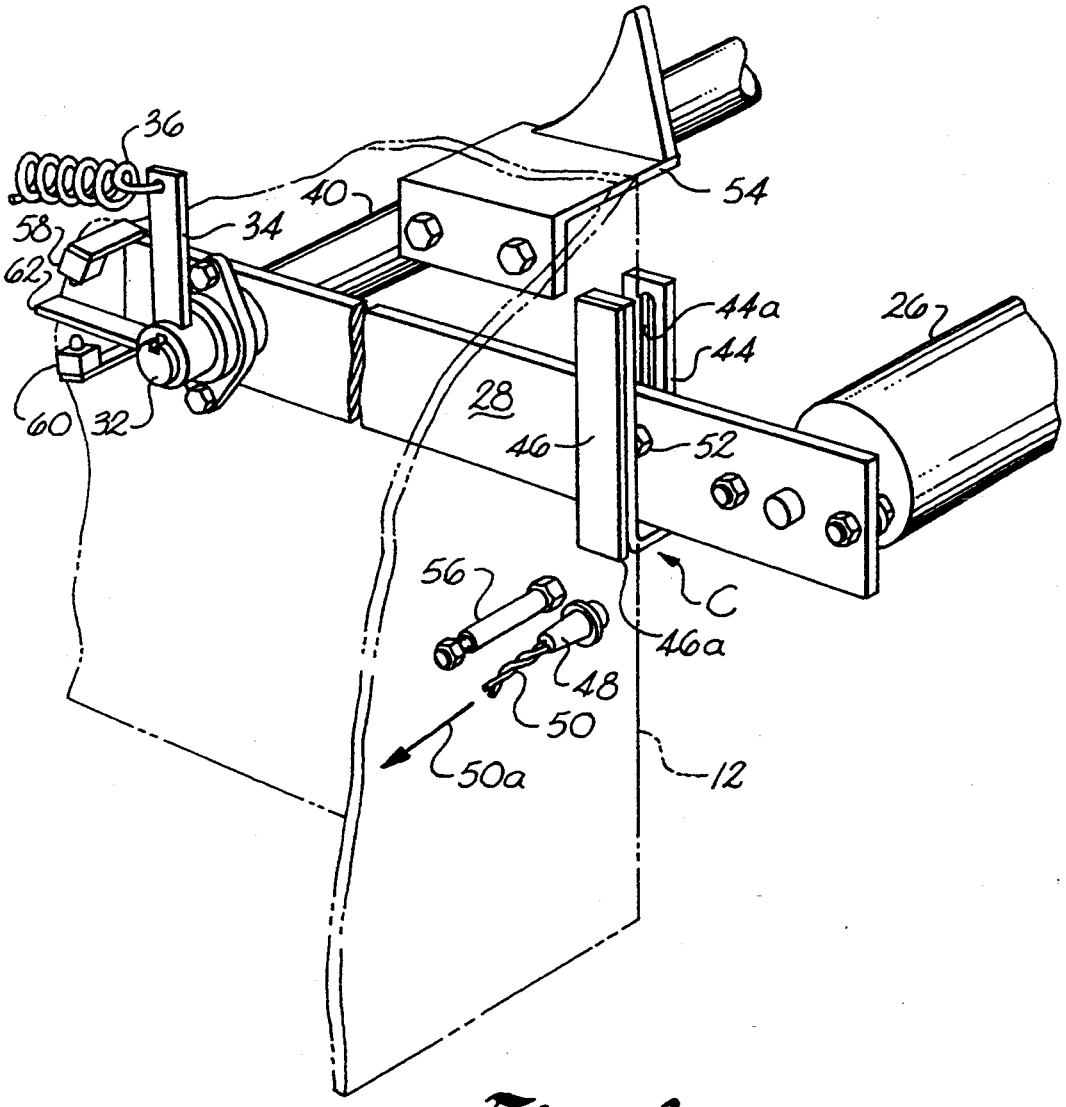
FIG. 3 is a perspective view with parts omitted showing a control system and method for an off-loom take-up according to the invention.

As can best be seen in FIG. 3, a detector device, designated generally as C, is illustrated for detecting movement of directional roll 26. The detector may be carried in any manner to sense the movement of directional roll 26, and in the illustrated embodiment, the detector device includes an adjustable attachment 44 which supports a detector object 46, and a detector switch 48. Electrical wiring 50, which transmits an electrical signal produced by detector switch 48, is routed to motor controller A. For this purpose, it is preferred that detector switch 48 be mounted to the frame or housing part 12, and detector object 46 is mounted to first pivotal arm 28. It is to be understood, of course, that the detector object and detector switch may be mounted in reverse positions, i.e. detector switch 48 mounted on arm 28 and detector object 46 mounted on frame 12, as well as to other parts of the take-up. However, to simplify the electrical wiring, the illustrated embodiment is preferred. Adjustable attachment 44 is illustrated as including an adjustable bracket having an adjustment slot **44*a* which receives a threaded bolt 52. Bracket 44 may be adjusted in its vertical position to alter the position at which a detector object 46 comes into proximity with detector switch 48 thereby producing an electrical signal 50*a*. The detector object and switch may be provided in many standard forms such as the provision of an elongated strip magnet 46 as the detector object, and the provision of a magnetic proximity switch (e.g. magnetic reed switch) for detector switch 48. As can best be seen in FIG. 1, when directional roll 26 descends from a first, operational position (full line) to a second position 26*a* (dotted line), detector magnet 46 comes into the proximity range of detector switch 48 causing electrical signal 50*a* to be produced and transmitted to motor controller A. In this event, electrical signal 58 switches motor controller A into a high speed mode so that drive motor 18 is driven at a high speed, compared to the preset speed, driving take-up rollers 14, 16 and cloth roll R at a higher speed to move the directional roll away from the second position. This brings directional roll 26 back within an operational range closest to the full line position. As soon as detector object 46 moves away from the proximity of detector switch 48, the high speed signal is terminated and the drive motor returns to its preset speed which is generally constant. With detector magnet 46** being provided in the form of an elongated strip, it will not be likely that the magnet can disappear below the proximity switch and render the control inoperative, i.e. it would no longer be probable that conditions would allow switching and high speed operation to lift the arm.

Any suitable motor controller A may be used in accordance with the invention. One suitable controller is manufactured by K & B Electronics, Inc. of Brooklyn, N.Y., model number KBLC-120. The motor controller is modified by placing a resistor in series with the reference output of the manually adjustable potentiometer which is adjustable by manual knob 22 to provide the preset constant speed and cloth speed differential. A parallel bypass circuit is placed around the resistor containing normally closed contacts. The normally closed contacts are open when proximity switch 48 is actuated. This places the resistor in the circuit electrically shifts and increases the reference voltage. This results in a voltage increase signal to the motor to momentarily place it in the high speed mode of operation. When the switch is deactuated, the fixed, preset slower speed of the motor is resumed.

Mechanical stops are provided by an angle bracket 54 and a cantilevered bolt 56 to limit the upward and downward movements of pivotal arm 28. Electrical limit switches 58 and 56 are provided which are actuated by a rearwardly extending arm 62 also affixed to shaft 32 along with arm 34. In the event that a malfunction occurs in the take-up drive, causing the termination of cloth take-up, directional roll 26 will drop, causing upper electrical limit switch 58 to be actuated. Electrical switch 58 will cause the loom to be shut down until the malfunction is corrected. Likewise, should the loom malfunction, and the take-up continue to wind cloth, directional roll 26 will be lifted causing lower electrical switch 60 to be actuated. This causes the take-up to be shut down until the loom malfunction is corrected. Directional roll 26 is allowed about 20 degrees of travel between the limits.

Figure 4A:
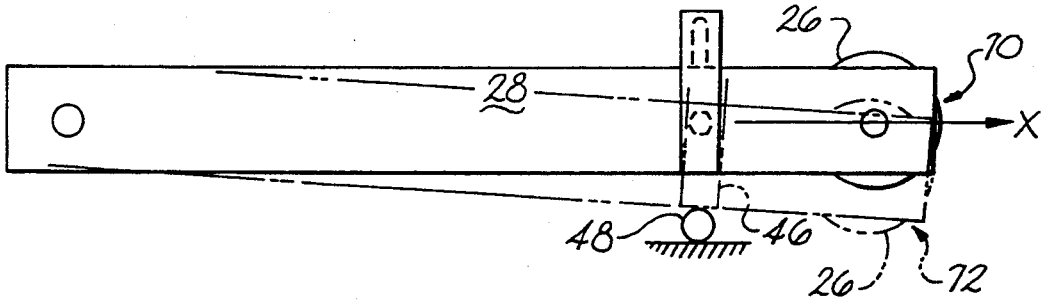
FIGS. 4A–4C are a schematic illustration of a control system and method for an off-loom take-up according to the invention.
Figure 4B:
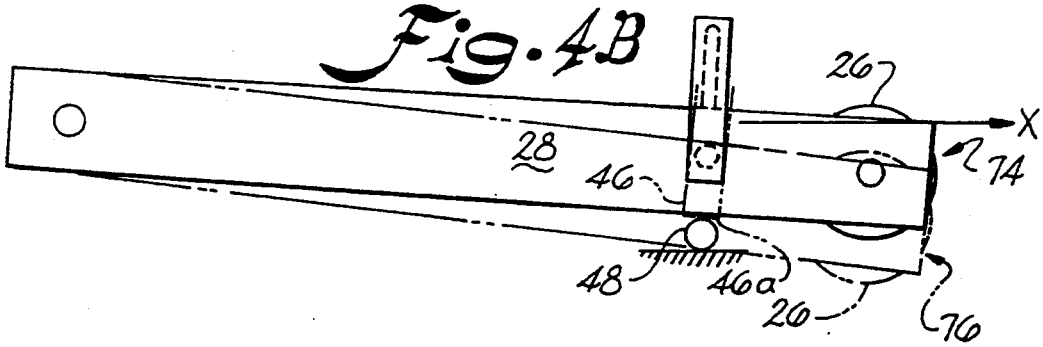
Figure 4C:
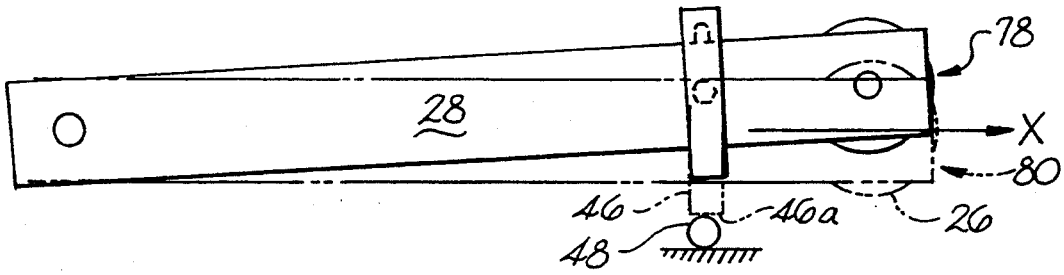

In operation, and in accordance with the method and system of the present invention, reference will be had to FIGS. 4A–4C. In accordance with the method of the present invention, the position of directional roll 26, with cloth 24 traveling underneath the roll, is determined by the speed of drive motor 18. This is preset manually by turning manual control knob 22 while visually using the position of directional roll 26 as a speed indicator. It is desired to establish a predetermined speed differential between the speed of the cloth leaving the take-off rolls of the loom and the speed of the cloth at the directional roll, i.e. linear rate at take-up. This predetermined speed differential is established by setting the speed of the cloth 24 at the directional roll to be slightly slower than the speed at which the cloth is traveling from the take-off rolls of the loom. This will establish a predetermined downward "creep" in the movement of directional roll 26. For example, in the preset configuration of FIG. 4A, directional roll 26 assumes a generally horizontal, first position, as shown at 70 (full line), lying generally at a horizontal plane X. Since a predetermined downward creep is established in the movement of directional roll 26, it will be virtually impossible for directional roll 26 to move upwards curing normal operating conditions. When directional roll 26 creeps downward to the second position at 72 (dotted line), the detector magnet is detected by switch 48 and the drive motor is momentarily operated at high speed. As directional roll 26 raises, the slack is removed from the cloth, and detector magnet 46 is moved out of the range of detector switch 48 and the preset, slower speed is resumed. An operational range (e.g. ⅜ of an inch) is provided between directional roll positions 70 and 72 in which a generally preset tension is applied to the cloth.

Referring now to FIG. 4B, an adjustment in preset tension placed upon the cloth by directional roll 26 is illustrated by adjusting the operational range. There is a first position 74 (full line) of the directional roll. In this configuration, attachment bracket 44 is moved upward from the position shown in FIG. 4B. This causes the leading end 46*a* of the detector magnet to be raised relative to the position shown in FIG. 4A. This allows directional roll 26 to creep further downward before reaching the second position 76 (dotted line) at which the high speed motor signal is produced. The creep, of course, is produced by the preset speed differential between the take-up and loom. Directional roll 26 will be maintained within a range of a operational position 74 by the control system and method. Since the geometry of the cloth is changed in this position, the tension will also be changed and maintained.

Referring now to FIG. 4C, another operational range and tension will be described wherein adjustment of the detector results in directional roll 26 operating in a range above the horizontal. In this configuration, directional roll 26 has a first position 78 (full line) and second position 80 (dotted line). Adjustable bracket 44 is moved downward causing leading edge 46A of the detector magnet to come within the proximity of switch 48 at an earlier time than in FIGS. 4A and 4B. This causes the motor controller to place the drive motor in high speed operation raising directional roll 26 to operational or first position 78 (full line) from a second position 80 (dotted line). Directional roll 26 will stay near first position 78 until it creeps downwardly to second position 80 whereupon detector magnet 46 comes within the proximity of detector switch 48 again operating the take-up at high speed and raising directional roll 26. Due to the preestablished speed differential, directional roll 26 will not rise above position 78 unless magnet strip 46 is lowered further. It will be noted in FIG. 4C, that the drive motor is in the high speed mode at first position 78 rather than at the slower preset manual speed which the drive motor is at when directional roll 26 is in first positions 70, 74. This is generally true in the illustrated embodiment when operating above horizontal plane X. The changed geometry of the cloth with directional 26 operating in the range of position 78 results in a geometry change in the path cloth 24 travels and a preset tension on the cloth. The value of the preset tension will depend on the configuration of spring 36, i.e, whether it is mounted to the left Or the right of arm 34 and spring constant (coarse tension adjustment), and the position of the directional roll as maintained by the detector position and control system (fine tension adjustment), as described above.

While the preset positions of directional roll 26 are shown with some distance between the first and second positions for purposes of illustration, in actual practice this operational range of movement will be relatively small, e.g. three-eighths of an inch to one inch. In accordance with the invention, the provision of an adjustable position between the detector object and detector switch allows for an easy way of adjusting the tension placed on the cloth by directional roll assembly B during operation. This provides a convenient means to provide a fine adjustment to the tension of the fabric in accordance with the apparatus and method of the present invention.

While a preferred embodiment of the invention has been described using specific terms, such description is for illustrative purposes only, and it is to be understood that changes and variations may be made without departing from the spirit or scope of the following claims.

What is claimed is:

1. An off-loom take-up for winding a cloth roll from woven cloth coming from a loom comprising:

a frame;

a pair of spaced take-up rollers carried by said frame, at least one of said take-up rollers being a driven take-up roller;

a drive motor having an output shaft for driving said driven take-up roller;

a motor controller for controlling the speed of said output shaft of said drive motor;

a pivotal directional roll assembly carried by said frame including a directional roll about which said cloth travels from said loom to said cloth take-up roll, and said directional roll having a first position in which said roll applies a preset tension to said cloth;

a motor controller having a first speed signal and a second speed signal, said motor controller operating said drive motor at a first speed in response to said first speed signal, and said motor controller operating said drive motor at a second speed which is higher than said preset speed in response to said second speed signal; and a detector responsive to a movement of said pivotal directional roll to a second position displaced from said first position of said directional roll for producing an electrical signal which is delivered to said motor controller for producing said second speed signal so that said drive motor momentarily operates at said high speed until said directional roll moves away from said second position.

2. The apparatus of claim 1 including:

first and second spaced pivotal arms carried by said frame, and said directional roll being carried by said pivotal arms;

said detector including a detector switch carried by one of said frame and said first pivotal arm, and said detector including a detector object carried by the other of said frame and said first pivotal arm.

3. The apparatus of claim 2 including an adjustable attachment for adjustably mounting one of said detector switch and said detector object with respect to the other so that the relative position between said detector switch and detector object may be varied to vary the location of said second position of said directional roll.

4. The apparatus of claim 3 wherein said detector switch comprises a magnetic proximity switch, and said detector object comprises a magnet.

5. The apparatus of claim 4 wherein said detector object comprises an elongated magnetic strip carried vertically with respect to said detector switch so that said detector object cannot entirely pass below said detector switch.

6. The apparatus of claim 2 including first and second stub shafts affixed respectively to said first and second pivotal arms, and a hollow torsion tube connected between said first and second stub shafts to resist relative twisting of said first and second arms.

7. The apparatus of claim 6 including a biasing spring affixed to said first pivotal arm only for biasing said directional roll in a desired direction.

8. The apparatus of claim 1 including:

first and second spaced pivotal arms carried by said frame, and said directional roll is carried by said pivotal arms;

said detector including a detector switch carried by said frame; and said detector including a detector object carried by said first pivotal arm.

9. The apparatus of claim 8 including an adjustable attachment for adjustably mounting said detector object and said detector switch in different relative vertical positions to thereby vary said second position and the point at which said electrical signal is produced to place said drive motor in high speed operation.

10. The apparatus of claim 9 wherein said adjustable attachment comprises a bracket to which said detector object is affixed; and an attachment for affixing said bracket to said first pivotal arm at a plurality of different vertical positions to vary said relative vertical positions between said detector object and detector switch.

11. The apparatus of claim 10 wherein said detector object comprises an elongated magnetic strip carried vertically with respect to said detector switch so that said detector object cannot entirely pass below said detector switch.

12. An off-loom take-up for winding a cloth roll from woven cloth coming from a loom, said take-up having a pair of generally parallel, spaced take-up rollers upon which said cloth roll is supported and formed, at least one of said take-up rollers constituting a driven take-up roller which is rotated by a drive motor, first and second spaced pivotal arms carried by said frame, a directional roll carried by said pivotal arms so that said directional roll moves in an arcuate path, said cloth coming from said loom passing about said directional roll along a path to said cloth roll, a motor controller for controlling the operation of said drive motor in response to movements of said directional roll, said take-up comprising:

a manual control included in said motor controller for manually setting the operation of said drive motor to establish a preset, cloth speed differential between the rate of travel of said cloth leaving said loom and at said directional roll so that a desired creep is established in the movement of said directional roll during cloth take-up;

a detector responsive to movement of said directional roll from a first position to a second position displaced from said first position of said directional roll;

said detector producing an electrical signal in response to said directional roll reaching said second position;

said motor controller generating a high speed signal in response to said electrical signal to momentarily operate said drive motor at a high speed until said directional roll moves sufficiently away from said second position.

13. The apparatus of claim 12 comprising an adjustable attachment for carrying said detector so that said first and second positions of said directional roll may be varied to adjust the tension applied by said directional roll to said cloth.

14. The apparatus of claim 13 wherein said preset speed differential provides a cloth travel speed at said take-up which is slightly below a travel speed of said cloth coming from said loom so that a pre-determined downward creep is established in the movement of said directional roll which prevents movement of said directional roll upwards from said first position.

15. The apparatus of claim 12 comprising at least one spring connected to said first pivotal arm biasing said directional roll in a desired direction relative to said cloth.

16. The apparatus of claim 15 including first and second stub shafts affixed respectively to said first and second pivotal arms, and a hollow torsion tube connected between said first and second stub shafts to resist relative twisting of said first and second arms.

17. The apparatus of claim 15 including providing an interchangeable mount for said spring on said frame which allows said spring to be fixed in a first position for applying a biasing force to said directional roll in a first direction, and interchangeably affixed in a second configuration for applying a biasing force to said directional roll in a second direction opposite from said first direction.

18. A method for controlling cloth wound into a cloth roll on an off-loom take-up, said take-up having a pair of spaced, generally parallel take-up rollers, at least one of said take-up rollers be a driven take-up roller driven by a drive motor, a pivotal directional roll having a pivot arm pivotally carried by said frame, a motor controller for controlling the operation of said drive motor in response to pivotal moment of said directional roller said method comprising:

adjusting said motor controller to wind said cloth at a first speed which establishes a predetermined speed differential in the rate of cloth leaving said loom and arriving at said direction roll, and said pivotal directional roll having a first position which varies due to said speed differential;

detecting a movement of said directional roll to a second position below said first position of said directional roll;

producing an electrical signal responsive to said movement of said directional roll to said second position, and delivering said electrical signal to said motor controller; and producing a motor control signal in response to said electrical signal which places said drive motor in a high speed mode of operation momentarily until said directional roll moves sufficiently away from said second position toward said first position.

19. The method of claim 18 comprising:

adjusting said first position of said directional roll to apply a preset tension on said cloth coming from said loom;

providing a detector for detecting said movement of said directional roll to said second position; and adjustably mounting said detector to vary said first position and hence said preset tension placed upon said cloth by said directional roll.

20. The method of claim 19 including providing an adjustable mount for said detector to adjust a position of said detector.

21. The method of claim 19 including affixing a proximity detector to said frame near said directional roll, and affixing a detector object on a pivotal arm which assists in supporting said directional roll for detecting said first position.

22. The method of claim 19 including mounting said detector object on an adjustable bracket so that the vertical position of said detector object and hence said second position of said directional roll may be varied to vary the tension on said cloth.

23. The method of claim 18 including providing at least one spring for biasing said directional roll relative to said cloth.

24. The apparatus of claim 23 including an interchangeable mount for said biasing spring on said frame so that spring may be affixed in a first position for applying a biasing force to said directional flow in a first direction, and said spring may be interchangeably fixed in a second position for applying a biasing force to said directional roll in a second direction opposite to said first direction.

25. An off-loom take-up for winding a cloth roll from woven cloth coming from a loom, said take-up having a pair of generally parallel, spaced take-up rollers upon which said cloth roll is supported and formed, at least one of said take-up rollers constituting a driven take-up roller which is rotated by a drive motor, first and second spaced pivotal arms carried by a frame, a directional roll carried by said pivotal arms so that said directional roll moves in an arcuate path, said cloth coming from said loom passing about said directional roll along a path to said cloth roll, a motor controller for controlling the operation of said drive motor in response to movements of said directional roll, said take-up comprising:

first and second stud shafts affixed respectively to said first and second pivotal arms;

a biasing spring having a first end interconnected to said first pivotal arm and a second end attached to said frame, a hollow torsion tube connected between said first and second stud shafts to resist relative twisting of first and second arms; and whereby the need for a second biasing spring interconnected to said second pivotal arm is eliminated due to the effective torque resistance of said hollow torsion tube.

* * * * *